United States Patent [19]

Wenger

[11] 4,292,682

[45] Sep. 29, 1981

[54] WATER-TIGHT WINDER FOR A DIVER'S WATCH

[75] Inventor: Karl Wenger, Chambesy-Geneva, Switzerland

[73] Assignee: Boninchi, S.A., Geneva, Switzerland

[21] Appl. No.: 134,061

[22] Filed: Mar. 26, 1980

[30] Foreign Application Priority Data

Mar. 29, 1979 [CH] Switzerland ..... 2913/79

[51] Int. Cl.[3] ..... G04B 37/00

[52] U.S. Cl. ..... 368/289

[58] Field of Search ..... 368/288–289, 368/308, 319, 298

[56] References Cited

U.S. PATENT DOCUMENTS

| | | | |
|---|---|---|---|
| 1,910,908 | 5/1933 | Weingartner | 368/289 |
| 3,389,551 | 6/1968 | Wyssen | 368/289 |
| 3,525,211 | 8/1970 | Wyssen | 368/289 |
| 3,535,869 | 10/1970 | Zellweger et al. | 368/289 |
| 4,089,158 | 5/1978 | Wenger | 368/289 X |

*Primary Examiner*—Vit W. Miska

[57] ABSTRACT

A water-tight push-piece for a diver's watch comprises locking means constituted by a sleeve fitted inside a head located around a tube intended to be secured to the watch case. This sleeve is not able to rotate but is able to slide on the tube and is provided externally with a screw-thread co-operating with an internal screw-thread on the head, in order to be able to move axially during rotation of the head. A gasket is disposed between the bottom of the sleeve and the tube. When the push-piece is locked, the bottom of the sleeve abuts against the end of the tube thus compressing the gasket.

3 Claims, 1 Drawing Figure

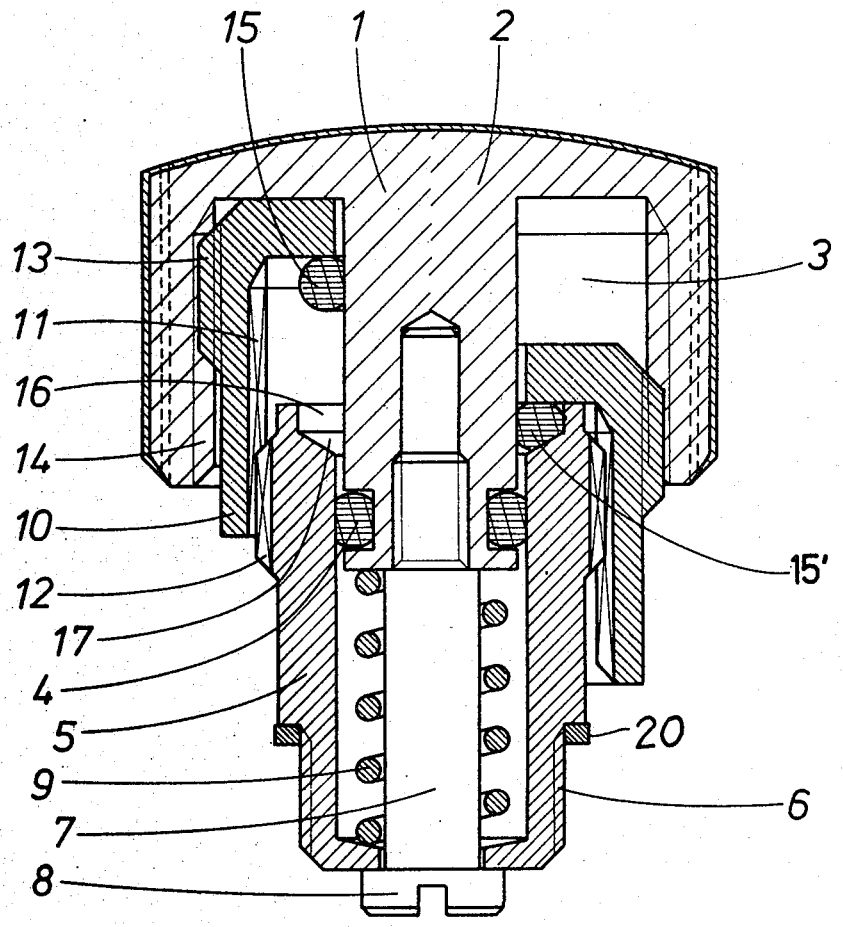
15
1
2
13
3
11
16
14
10
15'
12
17
4
5
20
9
6
7
8

WATER-TIGHT WINDER FOR A DIVER'S WATCH

FIELD OF INVENTION

The present invention relates to a water-tight push-piece for a diver's watch, comprising a recessed head provided with a core integral with a rod and mounted on a tube intended to be fixed to a watch case, a return spring between the tube and the head, a gasket mounted in the tube and means for locking the push-piece in the inoperative position.

BACKGROUND OF THE INVENTION

A push-piece of this type is described in Swiss Pat. No. 423 638. The locking means are constituted by an outer collar mounted on the head of the push-piece by means of a screw-thread, the head comprising internal splines co-operating with splines on the tube, which enable the head to slide on the tube but prevent the latter from rotating. When the collar is screwed, the latter comes to bear against the watch case, thus immolizing the push-piece in the inoperative position.

In this previous construction, when diving, in the locked position, water is able to penetrate through the splines, without it being possible to stop the latter by means of a gasket. On the other hand, when in the locked position, the collar, bearing against the watch case, exerts traction on the tube. This makes it necessary to use a screwed tube, since there is a risk that a tube which is driven-in would be torn out.

SUMMARY OF THE INVENTION

The present invention intends to obviate the above-mentioned drawbacks.

The push-piece according to the invention is characterized by the fact that the locking means are constituted by a sleeve mounted inside the head around the tube, which is prevented from rotating but is able to slide on the tube and is provided externally with a screw-thread co-operating with an internal screw-thread on the head in order to be able to move axially during the rotation of the head, an additional gasket being disposed between the bottom of the sleeve and the tube, so that when the push-piece is in the locked position, the bottom of the sleeve abuts against the end of the tube by compressing the gasket.

The sleeve does not come into abutment with the case, so that there is no traction on the tube, which makes it possible to use a push-piece which is driven-in. On the other hand, water penetrating the splines is stopped by the additional gasket.

Preferably, the push-piece is of the type comprising a core sliding in the tube and provided with a gasket, the return spring being mounted between the end of the core and the bottom of the tube.

In this case, the additional gasket, constituted by an O-ring seal, surrounds the core so that in the locked position, this O-ring seal is compressed simultaneously against the tube and against the core. The return spring is thus doubly protected.

The upper end of the tube preferably comprises an annular housing with a frustoconical base, in which the additional gasket engages. This frustoconical inlet also facilitates the engagement of the core in the tube, i.e. the mounting of the push-piece. A push-piece of this type may also be completely assembled before it is fitted on the watch case. The tube may be screwed or driven into the case.

BRIEF DESCRIPTION OF DRAWING

The accompanying drawing is a schematic longitudinal section which illustrates one embodiment of the invention by way of example.

DESCRIPTION OF PREFERRED EMBODIMENT

The single FIGURE of the drawing is an axial sectional view of the push-piece, the left-hand half showing the push-piece released and the right-hand half showing the push piece in the locked position.

The push-piece comprises a head 1 provided with a central core 2 surround by a recess 3, the core being provided with an O-ring seal 4 seated in an annular groove in the core and engaging in a tube 5 provided with a screw-thread 6 for securing it to a watch case. A gasket 20 assures a water-tight connection. Screwed to the core 2 is a rod 7 provided with a head 8 which abuts against the lower end of the tube. A return spring 9, which is subject to compression, is fitted in the tube 5, between the bottom of this tube and the end of the core 2.

Mounted inside the head 1 is a sleeve 10 provided with vertical splines 11 co-operating with splines 12 formed on the tube 5. Externally, the sleeve 10 is provided with a screw-thread 13 co-operating with a screw-thread 14 inside the head. Fitted around the core 2 and inside the sleeve 10 is an additional gasket constituted by a second O-ring seal 15. The upper end of the tube 5 comprises an annular recess 16 with a frustoconical base 17.

The head may be round, provided with splines or shaped.

In the position illustrated on the left in the drawing, the push-piece is in the released position and can be actuated. When one wishes to lock the push-piece in the inactive position, the head 1 is rotated, which has the effect of causing the sleeve 10 to descend, the latter being prevented from rotating. At the end of its travel, the sleeve 10 abuts the upper end of the tube 5. It is possible to screw the head 1 home without any risk of tearing out the tube 5. On the contrary, this screwing acts in the same direction as that in which the tube is screwed to the case. This screwing home of the head makes it possible to lock the push-piece in an absolutely reliable manner. Simultaneously, the O-ring seal 15 engages in the recess 16, if it is not there already and it is compressed by the sleeve 10 simultaneously against the walls of the recess 16 and against the core 2, ensuring an optimum seal whilst being able to deform freely inside the recess 16 without any danger of it being compressed excessively and damaged, as illustrated at 15'.

As a variation, the screw-thread 6 on the tube could be eliminated when the tube is driven-in.

What is claimed is:

1. A water-tight push-piece for a diver's watch comprising a recessed head provided with an axially extending core, a rod unitary with said core, a tube in which the rod is mounted and which is intended to be secured to a watch case, a return spring located between the tube and the head, a first gasket between said core and the tube, means for locking the push-piece in an inoperative position and comprising a sleeve having a base and mounted inside the head around the tube, which sleeve is prevented from rotating but is able to slide axially on the tube and defines externally a screw thread cooperating with an internal screw-thread defined by the head in order to move axially upon rotation of the head, and a second gasket located between the base of the sleeve and an end of the tube whereby, in the locked inoperative position of the push-piece, the base of the sleeve abuts against the end of the tube thus compressing the gasket.

2. A push-piece as claimed in claim 1, in which the core engages in the tube and the return spring is mounted around the rod between the bottom of the tube and the end of the core, the second gasket being mounted in a recess around the core and said end of the tube comprises an annular recess in which the second gasket is received when in the push-piece is in locked inoperative position and which gasket is constituted by an O-ring seal.

3. A push-piece as claimed in claim 2, in which said recess has a frustoconically shaped base.

* * * * *